United States Patent [19]

Moss et al.

[11] Patent Number: 4,664,498

[45] Date of Patent: May 12, 1987

[54] FILM-PROCESSING APPARATUS

[75] Inventors: Brian F. Moss, Chelford; Richard J. Brent, Handforth, both of England

[73] Assignee: Ciba-Geigy AG, Basel, Switzerland

[21] Appl. No.: 877,956

[22] Filed: Jun. 24, 1986

[30] Foreign Application Priority Data

Jun. 25, 1985 [GB] United Kingdom ..... 8516055

[51] Int. Cl.[4] ..... G03D 13/06

[52] U.S. Cl. ..... 354/313; 354/316; 354/329; 354/337

[58] Field of Search ..... 354/310, 312, 313, 314, 354/316, 323, 329, 330, 331, 333, 335, 337, 311

[56] References Cited

U.S. PATENT DOCUMENTS

| | | | |
|---|---|---|---|
| 2,781,708 | 2/1957 | Perlin | 354/311 |
| 3,605,601 | 9/1971 | Okayama et al. | 354/335 |
| 4,001,857 | 1/1977 | Ikechi et al. | 354/337 |
| 4,134,666 | 1/1979 | Kikuchi | 354/329 |
| 4,171,055 | 10/1979 | Lindgren | 414/412 |
| 4,428,658 | 1/1984 | Moore et al. | 354/310 |
| 4,514,070 | 4/1985 | Norris | 354/313 |
| 4,586,803 | 5/1986 | Moss et al. | 354/313 |

*Primary Examiner*—A. A. Mathews

*Attorney, Agent, or Firm*—Harry Falber

[57] ABSTRACT

An apparatus for the processing of a film, contained in a cassette being of the kind comprising a substantially cylindrical cassette body formed with a light-tight, longitudinally extending film exit slot device, end caps on said cassette body and a spool held between these end caps and having the film wound thereon, comprises a light-tight enclosure provided with a cassette body-retaining block shaped to receive and retain the cassette body, and also provided with a space intended to contain liquid for processing the film and being sufficiently large to receive from the cassette the spool with the film wound thereon. A gripping organ for engaging an end cap of the cassette permits relative movement between the retained cassette and the gripping organ such that, when they are moved away from one another, an end cap of the cassette is pulled off the cassette. At the same time, a spool engaging element pulls the spool with the film wound thereon, out of the cassette body and into the space.

6 Claims, 3 Drawing Figures

FILM-PROCESSING APPARATUS

BACKGROUND OF THE INVENTION

This invention relates to an apparatus for processing exposed lengths of photographic film material.

Most often nowadays, lengths of photographic film are coiled on a spool in a film cassette. After the film has been exposed in a camera, the cassette is removed therefrom and the cassette is opened in the dark. After the film leader has been trimmed, the length of film is wound into an open spiral which holds the film length at its edges. After the entire length of the film has been wound into the spiral, usually by hand, the spiral is placed in a light-tight processing drum and a light-tight lid is placed thereon. Thereafter the drum can be taken into the daylight and processing liquid can be poured into the drum and removed therefrom in daylight. After processing is complete the lid is removed from the drum and the film is washed and examined.

However, a large number of people do not like operating in the dark, and in a modern house it is often difficult to provide an area which is sufficiently light-proof to enable a highly sensitive film to be taken out of the cassette and wound into the spiral without the risk of fogging the film.

A number of attempts have been made to provide a processing device in which the loaded cassette is placed in full daylight in the processing unit and the film is wound from the cassette into a spiral mounted already in the device. However, such devices have been found to be difficult to operate, to be very bulky and expensive and often to require a large volume of processing liquid to fill the processing tank portion of the device. Thus, wide-spread use has not been made of such daylight loading processing tanks. Nevertheless, various daylight processing methods have been described in the past in published patents but none of these has found wide acceptance. For instance, in U.S. Pat. No. 2,781,708 the film is loaded into a special type of film holder or cartridge; such a cartridge requires a special camera because this cartridge is not the well known film cassette as used in the majority of 35 mm cassettes. In U.S. Pat. Nos. 3,605,601 and 4,001,857 there are described devices wherein a film on a spool is processed in situ in a film cassette. In practice, a film processed in such devices is processed very unevenly with very poor results. In U.S. Pat. No. 4,134,666 there is described a film processing system in which a film is transferred from a cassette to a spool which can be withdrawn into a light-tight enclosure. This enclosure can then be positioned over a plurality of processing baths and the film lowered into each bath. This system is complex to use and requires several pieces of equipment. In U.S. Pat. No. 4,171,055 there is described a complex and expensive device for removing a film on a spool from a cassette. Such a device could be used when a film is to be wound onto the normal spiral developing tank.

Finally, a device for opening film cassettes has been described in GB-PS No. 2 067 163, which involves deforming of the lower end cap, at the shorter hub end of the cassette, inwardly so as to open the crimp of the cap about the cassette end, by contacting the upper cassette end with a first counter-pressure member and hitting the lower end cap with a second pressure member.

OBJECTS AND SUMMARY OF THE INVENTION

It is an object of the invention to provide apparatus for the proccessing of a film which is simple and easy to use.

This object and others that will become apparent from the description of the apparatus according to the invention hereinafter, are attained with an apparatus for the processing of a film, contained in a cassette of the kind comprising a substantially cylindrical body formed with a light-tight, longitudinally disposed lipped film exit slot unit, end caps for the cassette body and a spool held between the end caps and having the film wound thereon, which apparatus comprises a light-tight enclosure comprising holding means shaped to receive and retain the cassette body; a base; an internal space destined to contain liquid for processing the film and being sufficiently large to receive, from the said cassette retained in the holding means, the spool with the film wound thereon; gripping means for engaging an end cap of the cassette and being adapted for axial movement relative to the said retained cassette, in a manner such that, by such movement, the gripping means will pull an end cap of the cassette off the cassette; and spool-engaging means adapted for pulling the said spool with the film wound thereon out of the cassette body and into said space, due to the said relative movement.

The apparatus according to the invention may be used for the daylight unloading of cassettes into a processing space which is not bulky and, although the apparatus does not comprise a spiral member for holding the film, very satisfactory processing results can be obtained by use of the apparatus.

Preferably, the light-tight enclosure comprises an upper columnar body, made of a light-opaque material, for accomodating a centrally apertured block to receive the cassette and retain the cassette body. This cassette body-retaining block has a central passage through which the lower end cap of the cassette and the spool having a film wound thereon can pass, but also comprises, in the inner face of its passage sidewall at least one axially extending recess or groove closed at its lowermost end and of such a shape that the lipped film exit slot unit with which all suitable cassettes are equipped, fits into that groove.

The body of the cassette cannot pass through the cassette body-retaining means because the axially extending groove in which the lipped exit unit of the cassette is located, prevents this.

The cassette body-retaining block can be so formed that it exerts a compressive grip on the cassette body as well as supporting it in its central passage or bore. This may be achieved by forming the block in two halves or employing an axially split cylinder. The cassette is fitted into such a block and formed into the upper columnar body. This design of a cassette body-retaining block provides maximum support for the cassette body which is of particular importance with staked end caps.

In nearly all 35 mm film cassettes now being produced, one end of the spool on which the film is wound protrudes substantially through one end cap of the cassette (long hub end of spool). Most preferably it is this end cap which is pulled off and means are provided to prevent the cassette from being inserted in the device so that the other end cap through which the hub does not protrude becomes the lower end cap.

The end cap-gripping means are located in another columnar body, designated hereinafter as the tank body and also made of light-opaque material, which is connected to the upper body which contains the cassette body-retaining means by a light-tight connection such as screw means. The end cap-gripping means are engaged with the end cap of the cassette when the cassette is in the cassette body-retaining means and the two columnar bodies are connected with each other by the screw means. A lid is placed on the columnar upper body and this upper body is raised with regard to the columnar body which contains the end cap-gripping means, by actuation of the screw means. This causes the end cap to be pulled downward off the cassette and provides a space below the cassette body-retaining means sufficient to accommodate the spool with the film coiled thereon.

Preferably, in use, the end cap-gripping means are held stationary and the retained cassette can be moved away from the gripping means.

Moreover, preferably, the spool with the film coiled thereon is removed from the cassette body by use of a spool-engaging member which, when the cassette is in place in the cassette body-retaining means, enters into a cavity in the protruding spool end, and a notch in the top end of this spool-engaging member engages firmly with the axial member or members, preferably two being present in the hollow hub end of the spool. Thus, as the upper columnar body, which contains the cassette body-retaining means, is raised from the columnar tank body by an unscrewing action, the end cap will be pulled off by the end cap-gripping means and preferably drops toward the base of the tank body, and comes to rest on the spool-retaining member. Then, as the upper columnar body is further raised above the tank body, the spool with the film coiled thereon is retained in the upper end of the spool-engaging member and cannot rotate with the cassette body as the latter is raised. When the upper columnar body has been raised sufficiently, the whole of the spool with the film coiled thereon is then moved completely out of the cassette body. Thereby, it is pulled downwardly into the space in the columnar tank body below the cassette body-retaining means.

Processing liquid is introduced into this space by way of the means described below, and the film and/or the processing liquid is agitated in the space to cause the liquid to flow over all the areas of the surface of the film.

The apparatus is provided with light-tight channels and/or passages for introducing processing liquid into the space below the cassette body-retaining block, and for removing it therefrom. To this end the apparatus may have the channels or passages formed in the lid or the base plate, or a tube may be provided above the liquid space which tube passes through the sidewall of the tank body.

The liquid-receiving space in the tank body below the cassette body-retaining means should be dimensioned to hold enough liquid to process the film, but the volume of liquid required is usually much smaller than the volume required in most processing drums which comprise a spiral.

In a preferred embodiment of the apparatus according to the invention, means are provided in the base of the liquid-containing space for allowing liquid to enter this space when the apparatus is placed in a container of processing liquid, with its tank body sufficiently immersed in the liquid to fill the space. The processing step is carried out whilst the apparatus is in the processing bath. When the processing step is completed, the apparatus is lifted out of the bath and the liquid flows out of the apparatus. Again, such liquid entrance and exit means comprise a light labyrinth.

Preferably, the base of the liquid container space is so shaped to accomodate the lower end cap of the cassette in a central position thereon when pulled off the cassette body. The base may be so shaped as to provide bearing support to the hub end of the spool, thereby facilitating the rotation of the spool as the film is coiled and uncoiled thereon during processing.

As the coiled film on the spool leaves the cassette, it becomes only loosely coiled and processing liquid is able to penetrate between its windings and act over the whole surface of the film.

BRIEF DESCRIPTION OF THE DRAWINGS

Further objects and advantages of the invention will become apparent from the following more detailed description thereof in connection with the accompanying drawings in which.

In the figures of the drawings, like numerals designate like parts.

DETAILED DESCRIPTION OF THE EMBODIMENT SHOWN IN THE DRAWINGS

Figure 1:
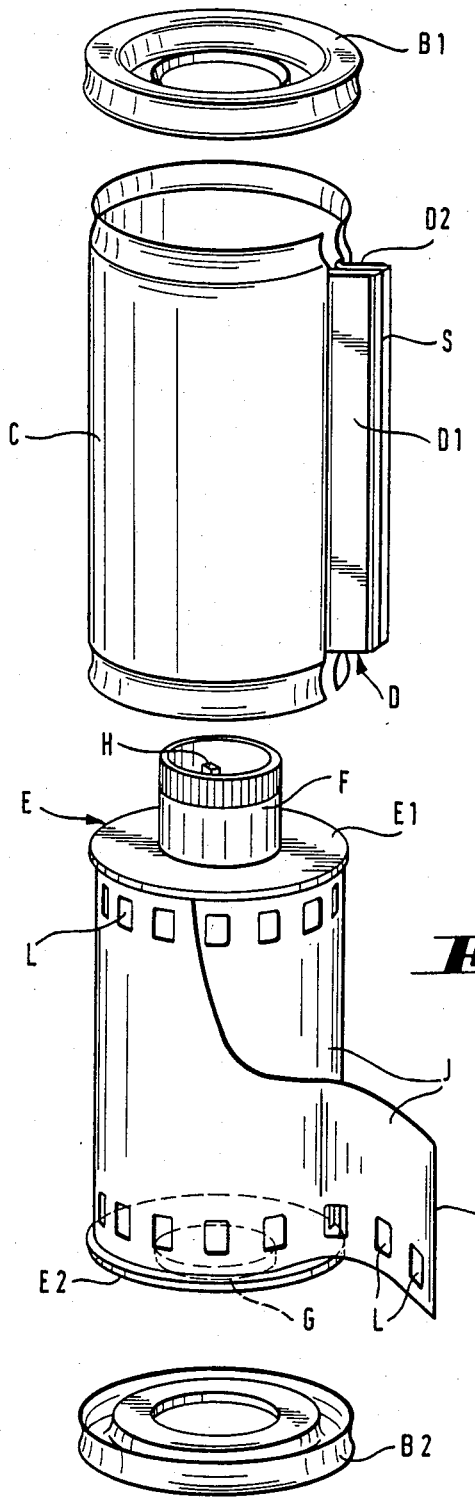
FIG. 1 is an exploded view of a 35 mm film cassette loaded with a length of film.

Referring now to FIG. 1 there is shown a normal 35 mm film cassette which comprises two annular end caps B1 and B2 and a substantially cylindrical cassette body C having a central axis CA and a light-tight film exit unit D comprising two longitudinally extending flanges or lips D1 and D2 having an open slot S therebetween, protruding on the outside of the cassette body in planes radial to the central axis of the cassette, and formed by pinching together the two ends of a metal strip from which the cassette body C is formed. The lips D1 and D2 protrude slightly beyond the periphery of the end caps B1, B2. The cassette body is intended to hold film J wound on to a flanged spool E which has a long hub end F and short hub end G. Located inwards of the hub end F and extending down into the hollow hub are axially projecting coupling members H (only one of which is shown) by means of which the spool E is located in a camera. The film J has a leading edge K and conventional sprocket holes L.

Figure 2:
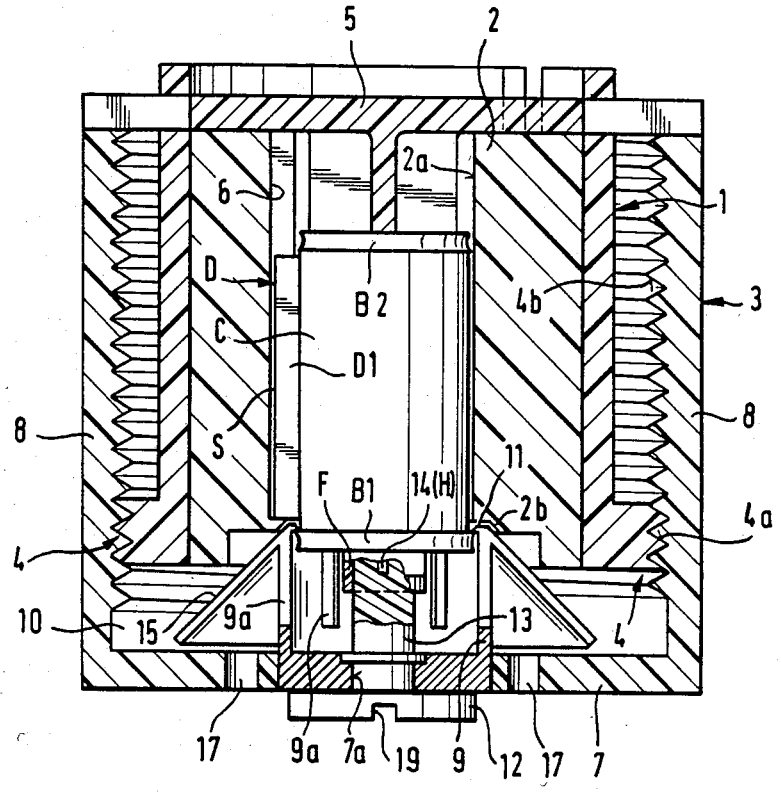
FIG. 2 is an axial sectional side elevation of a preferred embodiment of the processing apparatus according to the invention, with the apparatus in unextended position.
Figure 3:
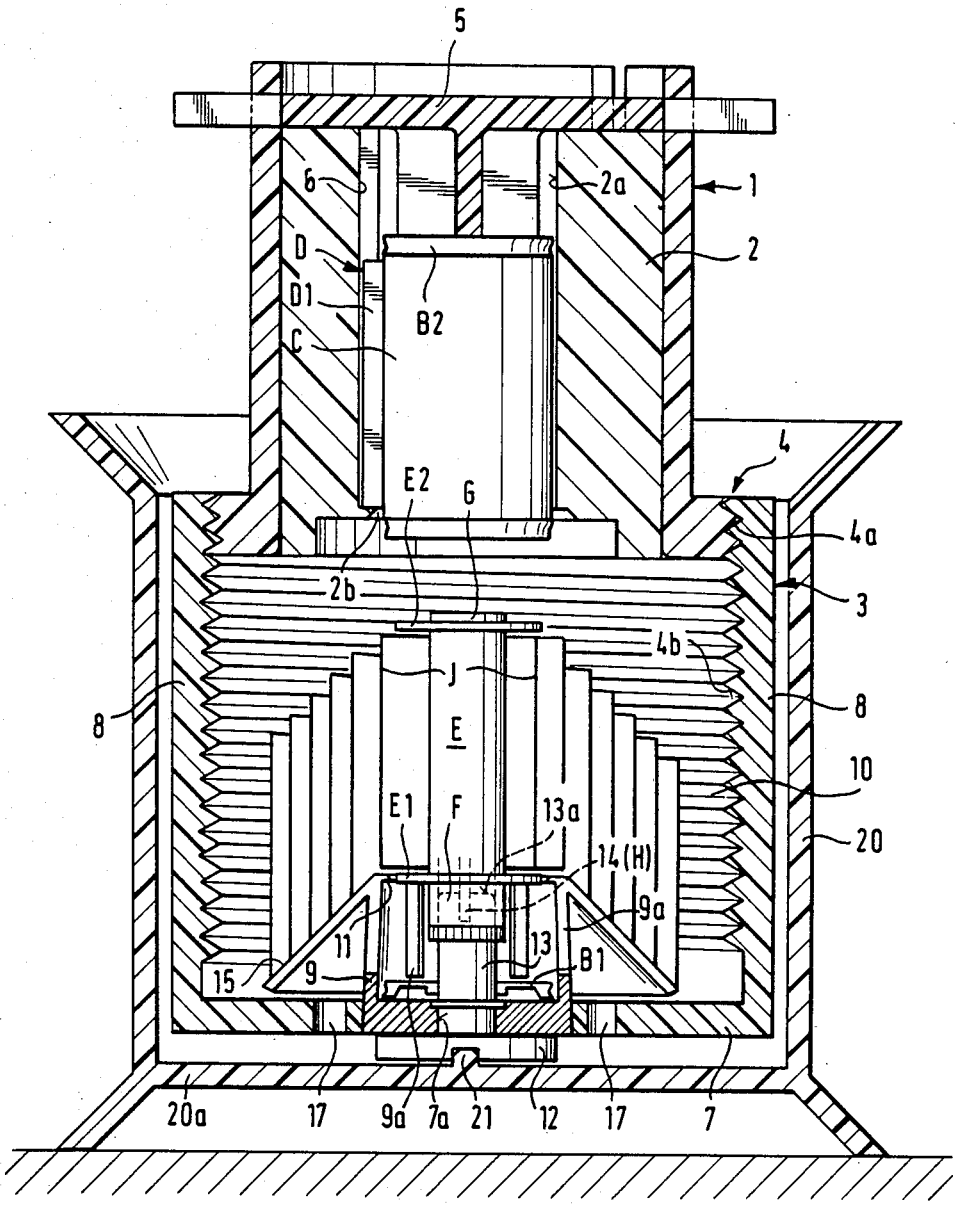
FIG. 3 is an axial sectional side elevation of the embodiment of FIG. 2, but with the parts in an extended position.

In FIGS. 2 and 3 there is shown a processing apparatus which comprises an upper, cassette-housing columnar body 1 and a wider columnar cup-shaped container or tank body 3 which is connected to the housing body 1 by a screw connection 4 which comprises an external threading **4*a* at the lower end of body 1 and an internal threading 4*b* at the upper end of body 3. A lid 5 fits into the top of the housing body 1. The bodies 1 and 3 and the lid 5 are all composed of a light-opaque plastics material, and, in a first stage of operation, the cup-shaped body 3 surrounds the housing body 1, while, at another stage, it is screwed to a lower level but still in light-tight engagement with the body 1**.

The housing body 1 has fitted therein a cassette body-retaining block 2. The cassette-retaining block 2 has a central passage 2*a* into which the entire cassette is introduced, but only the lower end cap of the cassette and the cassette spool having a film wound thereon can pass out of the lower open end 2*b* of the passageway 2*a*, while the retaining block 2 further comprises an axial groove 6 which is closed at its lowermost end and shaped to accomodate the lipped film exit unit D.

The tank body 3 comprises a base 7 and has a straight sidewall 8 which carries the internal threading 4*b* for most of its height. On the base 7 there is mounted an upwardly extending sleeve 9 the top end of which has a radially inwardly projecting annular flange 11. The sleeve 9 has axial slits 9*a* cut therein to make the sleeve slightly expandable when any downward and spreading force is applied to its inside. The dimensions of the sleeve 9 and the shape of the annular flange 11 are such that the flange just fits over an end cap B1 which protrudes through the cassette-retaining block 2 as shown in FIG. 2.

The base 7 has a central opening 7*a* in which there is mounted, centrally with regard to the sleeve 9 and rotatably, a spool-retaining member 12 which comprises a peg 13 projecting upwardly through the opening 7*a* and bearing in its upper end face 13*a* a transverse slot 14. As shown in FIGS. 2 and 3 the peg 13 fits into the cavity of hub end F, with the axially protruding members H in the hub end cavity fitting into the slot 14.

In base 7 there are also provided a number of liquid entry holes 17. Light is prevented from reaching inside the tank body 3 by conventional light trapping means (not shown). A transverse recess or groove 19 is provided in the central region of the underside of the spool-retaining member 12.

In FIG. 3 the apparatus is shown standing in a processing beaker 20. This processing beaker has at the center of the inside surface of its bottom wall 20*a* an upwardly projecting transverse nose or the like locking member 21 which is adapted to fit into the recess 19.

In operation, in order to process a film in a cassette, the upper body 1 is separated from the tank body 3. The film in the cassette is fully wound in and the cassette is placed in the cassette-retaining block 2 so that the long spool end F is lowermost. The lid 5 is then placed on the upper body 1. The interior 10 of the tank body 3 is empty.

Then the upper body 1 is placed onto the tank body 3 in a manner such that the transverse slot 14 in peg end face 13*a* of the spool-retaining member 12 fits firmly enough over the coupling members H to prevent rotation as well as axial displacement of the spool E away from the retaining member 12. The two columnar bodies 1 and 3 are then pressed together so that the annular flange 11 of the sleeve 9 fits over the end cap B1 and the end of the peg 13 of the member 12 fits into the hollow end of the spool F. The two threadings 4*a* and 4*b* are then engaged, and the housing body 1 is screwed down into the tank body 3 of the apparatus light-tight. This is the position shown in FIG. 2. The apparatus is then stood in the processing beaker so that the recess 19 in the underside of member 12 fits over stud 21 on the bottom of the beaker 20.

To force off the end cap B1, the processing beaker 20 is held stationary and the upper body 1 is screwed upwards. As the sleeve 9 is held against upward movement due to the engagement of the coupling member H and the retaining member 12 the upward movement of the housing body 1 forces off the end cap B1 which is gripped by the annular flange 11 and thus caused to fall over the peg 13 onto the member 12. The screwing action is continued and as the spool-retaining member 12 is prevented from rotating due to the recess 19 being engaged by the nose 21, continued movement of the upper body 1 upwardly from tank body 3 causes the member 12, which holds the spool E and coiled film J thereon, to pull them out of the cassette body C into the interior 10 of tank body 3. The upper body 1 is raised above the tank body 3 as far as the threading 4 will safely permit without the bodies becoming disengaged from each other. This is the position shown in FIG. 3.

The entire apparatus is then lifted out of the processing beaker 20 and the requisite amount of processing liquid to fill the tank body 3 above the level of the coiled film therein is introduced into the beaker 20. The apparatus is then returned to the beaker 20 so that recess 19 fits over the locking member 21. The processing liquid then enters the tank body 3 via the holes 17. The member 12 together with the spool E and the film J thereon is then caused to rotate by rotating the processing beaker 20. This rotation causes the windings of the film to spread and those away from the central axis toward the sidewall of the tank body 3 to slide down on a downwardly sloped frustoconical intermediary bottom part 15 which is attached to the upper end of the sleeve 9 and surrounds the latter, having its lower periphery spaced from the base 7 in order to permit the flow of processing liquid through the gap between these parts and over the surface of the film. Preferably, after a determined number of rotations in one direction of the beaker, the direction of rotation is reversed.

After the requisite processing time the apparatus is lifted out of the beaker 20 to allow the liquid to flow out therefrom. It is then stood in another beaker 20 containing a different processing liquid.

Then again, after the requisite processing time, the apparatus is removed from the beaker and stood in yet another beaker which contains wash water. This last step may be repeated a sufficient number of times to ensure that the film has been properly washed.

When using a monobath, only one processing solution is required in the processing beaker 20. When the processing and washing has been completed the apparatus is removed from the beaker 20 and all the liquid is allowed to drain from the apparatus through the holes 17. The upper body 1 is then completely unscrewed from the tank body 3 and the film J on the spool E as well as the end cap B1 are removed from the tank body 3. The lid 5 is removed from the upper body 1 and the cassette body C can be removed from the cassette-retaining block 2.

We claim:

1. An apparatus for the processing of a film contained in a cassette, the cassette being of the kind comprising a substantially cylindrical cassette body with light-tight longitudinally extending film exit slot means, two end caps attached to said body and a spool held between said end caps and having the film wound thereon, which apparatus comprises a light-tight enclosure having a central longitudinal axis and comprising a base;

housing means constituting a part of said enclosure and being adapted to receive and retain said cassette body therein, said light-tight enclosure having a space therein being sufficiently large to receive therein from said cassette said spool with said film wound thereon, and being destined for receiving processing liquid therein, gripping means for engaging an end cap of said cassette, said gripping means and said cassette being so arranged in said enclosure as to permit axial displacement relative to each other in a manner such that displacement thereof away from each other will cause said gripping means to pull said end cap engaged thereby off said cassette body, and spool-engaging means adapted for pulling said spool with said film wound thereon out of said cassette body and into said space.

2. The apparatus of claim 1, wherein said housing means comprise a first columnar body made of a light-opaque material, a centrally apertured block accomodated in said first body and adapted for receiving said cassette and retaining said cassette body, said block having a central passage destined for a lower end cap of said cassette and said spool having said film wound thereon passing therethrough, said first columnar body comprising at least one axial slot closed at its lowermost end and being shaped in a manner such that said film exit slot means of said cassette fit therein and retain said cassette body.

3. The apparatus of claim 2, wherein said light-tight enclosure comprises a second columnar body made of light opaque material; said gripping means being located in said second body; and thread means for connecting said first and second columnar bodies axially displaceably with each other.

4. The apparatus of claim 1, wherein said gripping means comprises axially extending sleeve means mounted on top of said base and having at its free end a radially inwardly extending annular flange and axial slits rendering said sleeve means slightly expandable.

5. The apparatus of claim 1, wherein said base is located below said liquid-receiving space and comprises light-tight passage means for allowing liquid to enter and leave said space when said apparatus is placed in a receptacle containing processing liquid.

6. The apparatus of claim 1, wherein said spool has an end thereof, destined for facing toward said space, and a cavity in said spool end, and wherein said spool-engaging means comprise an axially upwardly projecting stud portion having an end face and a notch therein, said stud portion being adapted for entering said cavity in said spool end face and preventing said spool from rotating.

* * * * *